US005099619A

United States Patent [19]

Rose

[11] Patent Number: 5,099,619

[45] Date of Patent: Mar. 31, 1992

[54] PNEUMATIC PARTICULATE BLASTER

[76] Inventor: Leo J. Rose, 145 Willowdale Dr., Apt. #13, Frederick, Md. 21701

[21] Appl. No.: 390,194

[22] Filed: Aug. 7, 1989

[51] Int. Cl.[5] ..... B24C 7/00; B24C 9/00

[52] U.S. Cl. ..... 51/436; 51/439; 241/39

[58] Field of Search ..... 241/5, 15, 39, 40; 51/411, 426, 436, 439

[56] References Cited

U.S. PATENT DOCUMENTS 2,612,320 9/1952 Croft ..... 241/39
2,821,346 1/1958 Fisher ..... 241/39
3,840,188 10/1974 Coombe et al. ..... 241/39

*Primary Examiner*—Timothy V. Eley
*Attorney, Agent, or Firm*—A. D. Cennamo

[57] ABSTRACT

A pneumatic particulate blaster apparatus consisting of a hopper having an open top for receiving particulate material and having a lower terminus communicating with generally cylindrically configured hollow tubing, vibrating means mounted on a lower side of the hopper, auger means in the tubing for feeding the particulate material received from the hopper to a nozzle at a distal end of the tubing and being driven by a prime mover from the other end of the tubing, particulate mix chamber communicating with the distal end of the tubing and receiving air at an inlet above the particulate mix chamber allowing particulate mix tending to aerate with air in a gravitational fall path through a distance in the particulate mix chamber and exiting adjacent a set of multiple venturi orifices in the nozzle communicating therewith, an air receiver tank for communicating with the multiple venturi orifices and having the multiple venturi orifices disposed generally inclined about 10° to an axis of the nozzle for ingress of pressurized air from air receiver tank into the multiple venturi orifices, and termination orifice directing ejection of air, water, and particulate mix to a work surface means.

10 Claims, 3 Drawing Sheets

FIG. 1A
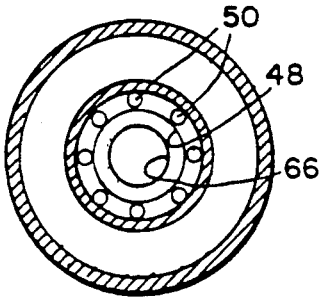
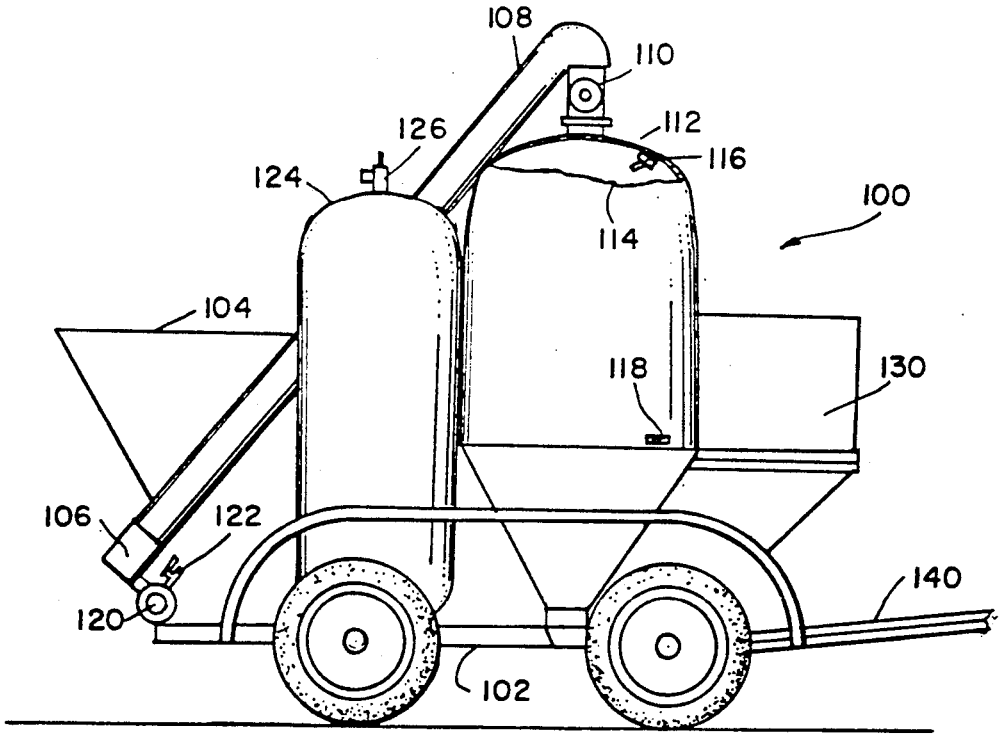
FIG. 2

PNEUMATIC PARTICULATE BLASTER

BACKGROUND OF THE INVENTION

1. Field of the Invention

The invention relates to an improved pneumatic particulate blaster apparatus consisting of a hopper having an open top for receiving particulate material and having a lower terminus communicating with generally cylindrically configured hollow tubing, vibrating means mounted on a lower side of the hopper, auger means in the tubing for feeding the particulate material received from the hopper to a distal end of the tubing and being driven by a prime mover from the other end of the tubing for metering the flow of particulate material, particulate mix chamber communicating with the distal end of the tubing and receiving air at an inlet above the particulate mix chamber allowing particulate mix tending to accelerate in a gravitational fall path through a distance in the particulate mix chamber and exiting adjacent multiple venturi orifices in a nozzle communicating therewith, an air receiver tank for communicating with the multiple venturi orifices and having the multiple venturi orifices disposed generally inclined about 10° to an axis of the nozzle for ingress of pressurized air from air receiver tank into the multiple venturi orifices, and termination orifice directing ejection of air, water, and particulate mix to a work surface means.

The invention relates further to a device providing for the outward flow of liquid in a pneumatic particulate blaster and the method of filling the supply tubing thereof as more particularly described herein.

2. Description of the Prior Art

Various prior art sand blaster devices, and the like, as well as apparatus and method of their construction in general, are found to be known and exemplary of the U.S. prior art are the following:

| | |
|---|---|
| Croft | 2,612,320 |
| Fisher | 2,821,346 |
| Coombe | 3,840,188 |
| Rose | 4,106,111 |

These patents or known prior uses teach and disclose various types of sand blaster devices of sorts and of various manufactures and the like as well as methods of their construction, but none of them whether taken singly or in combination disclose the specific details of the combination of the invention in such a way as to bear upon the claims of the present invention.

SUMMARY OF THE INVENTION

An object, advantage and feature of the invention is to provide a novel particulate material blaster utilizing high psi from a compressor to attain rapid velocities of particulate mix.

Higher psi air ejected from a set of multiple venturi orifices increases injection of air velocity proportional to the increases or decreases in air psi entering the set of multiple venturi orifices. More rapid evacuation of the inner atmosphere of the nozzle ahead of the set of multiple venturi orifices, caused by the higher psi of air through these set of multiple venturi orifices both increases the vacuum behind these set of multiple venturi orifices by increasing the particulate velocity and by providing a greater particulate velocity out of the nozzle. Increased particulate velocity permits lowering particulate ratio in fluid mixes by obtaining impacts commensurate with the increase in velocity and its effect on particle impact. Any hard materials, e.g. metals, cementitious materials, etc., can be cut or shaped by a stream of a fluid mass of either liquid and an abrasive, or air and an abrasive moving at a sufficient velocity as with commercial compressors able to generate psi's of over 5,000 and air velocities recorded and charted of over 10,000 fps; this unit of the invention by its unique meeting of compressed air and fluid mass at the nozzle will permit usages of exceptionally high psi air safely and without danger to workmen or extreme wear on breakage on the system components. Also where any of lesser psi levels are optionally, selective cutting or removal of one item without damage to another can be achieved, i.e., concrete removal from around reinforcement steel with little or no damage to the reinforcement steel.

With a wide range of psi and velocities available or possible from the adjusting of the compressor and by either increasing or decreasing metered feed motor to increase or decrease abrasive volume and an optimum ratio of abrasive to air can be arrived at and maintained. This ratio adjustment would be beneficial where a long distance factor exists between the blaster or machine and the nozzle man, as the effective range of the unit can be extended by a high psi/velocity air and a low particulate fluid mass less be effective with no lowering of efficiency. Also, less clean-upafter blasting and less outlay for abrasive material, also avails.

Another advantage of the invention is to provide a throat proximate the set of multiple venturi orifices to further increase the particulate velocity by being drawn through the venturi of the throat.

Another object of the invention is directed further to a device providing for the outward flow of supply liquid in a pneumatic particulate blaster and the method of filling the supply tubing thereof.

Also an object of the invention is to provide a simple and direct method for the improved construction of a pneumatic particulate blaster applicator that overcomes each and every objection over prior art devices.

These together with other objects and advantages which will become subsequently apparent reside in the details of the process and operation thereof as more fully hereinafter is described and claimed, reference being had to the accompanying drawings forming a part hereof, wherein like numerals refer to like parts throughout.

DESCRIPTION OF THE SEVERAL VIEWS OF THE DRAWINGS

FIG. 1A is a sectional view taken along line A—A of FIG. 1.

FIG. 2 is a side elevational view of a truck or trailer that may be used to transport the apparatus of the invention.

DESCRIPTION OF A PREFERRED EMBODIMENT OF THE INVENTION

Figure 1:
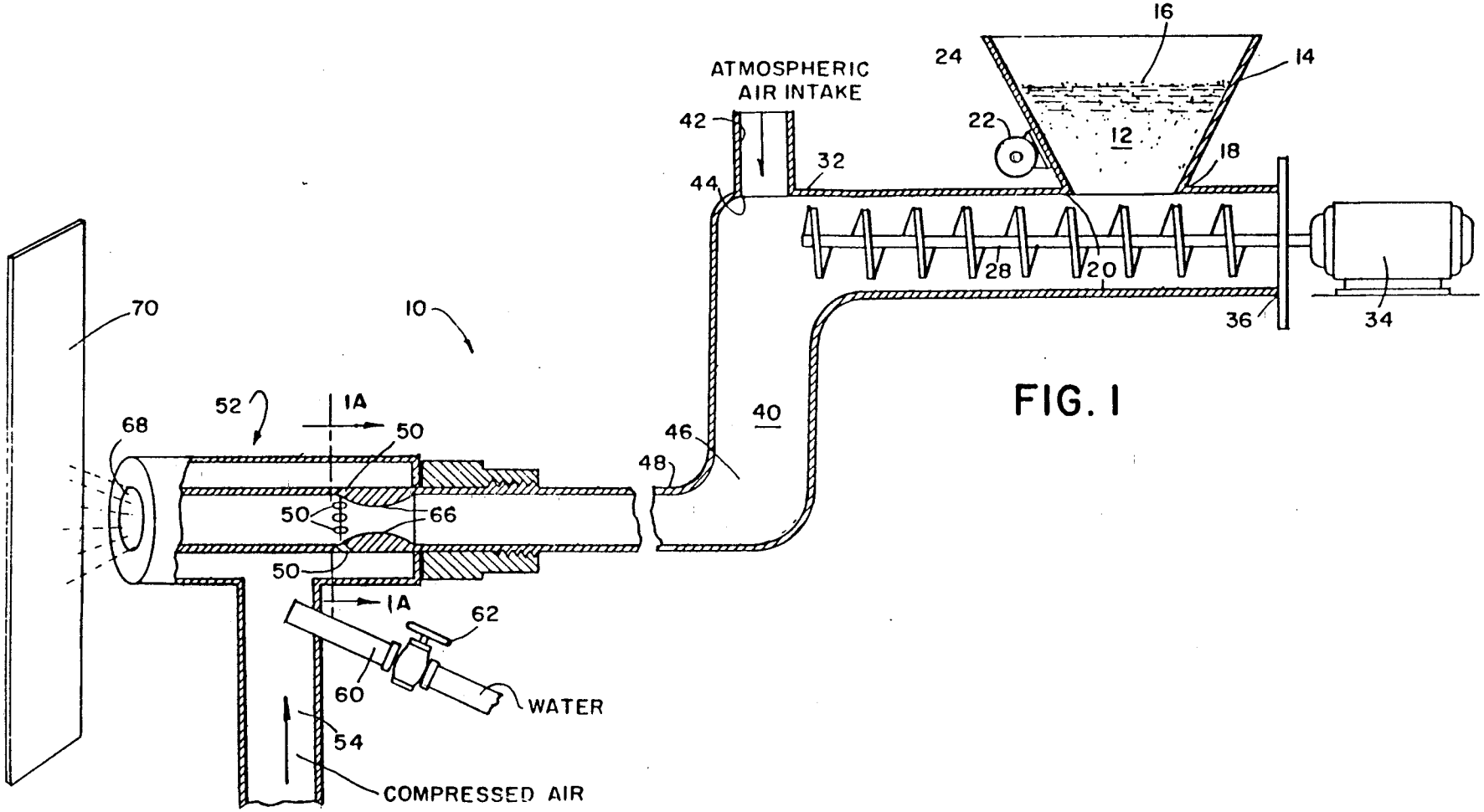
FIG. 1 is a partial sectional view of a pneumatic particulate blaster and illustrating a typical installation of the pneumatic particulate blaster apparatus according to a preferred embodiment and best mode of the present invention.

Referring now to the drawings there is shown in FIG. 1 a pneumatic particulate blaster apparatus 10 having a hopper 12 with an open top 14 for receiving particulate material 16 and having a lower terminus 18 communicating with generally cylindrically configured hollow tubing 20. Vibrating member 22 is mounted on an inclined side 24 of the hopper 12, as shown.

An auger member 28 is installed in the tubing 20 for feeding the particulate material 16 received from the hopper 12 to a distal end 32 of the tubing 20 and the auger member 28 is driven by a prime mover 34 and identified as a metering motor located at the other end 36 of the tubing 20.

A particulate mix chamber 40 communicates with the distal end 32 of the tubing 20 and a connection 42 provides for receiving and intaking atmospheric air at an inlet 44 above the particulate mix chamber 40 for allowing particulate mix tending to accelerate in and through a gravitational fall path 46 through a distance in the particulate mix chamber 40 and exiting into a conventional hose or coupling 48 and thence toward adjacent multiple venturi orifices 50 in a nozzle 52 therewith.

An air receiver coupling 54 (coupled to a compressed air receiver tank not shown but of any conventional construction) communicates air with the multiple venturi orifices 50 shown in FIGS. 1 and 1A and having the multiple venturi orifices 50 disposed generally inclined about 10° to an axis of the nozzle 52 for ingress of pressurized air from the air receiver tank into the multiple venturi orifices 50. Water injection to the nozzle 52 is provided by means of a water hose coupling 60 controlled by a water valve 62. The atmosphere at the exit or termination orifice 68 of the nozzle 52 provides a violent evacuation of air, tending to create a vacuum state, that draws the discharge from the nozzle 52. A contoured throat 66 is constructed and is significantly contoured, as shown, for augmenting the same function and result, and is so positioned upstream of the set of multiple venturi orifices 50 and for accelerating flow of the particulate mix as the particulate mix passes the contoured throat 66.

The termination or exit orifice 68 directs the ejection of air, water, and particulate mix to a work surface member 70.

Figure 4:
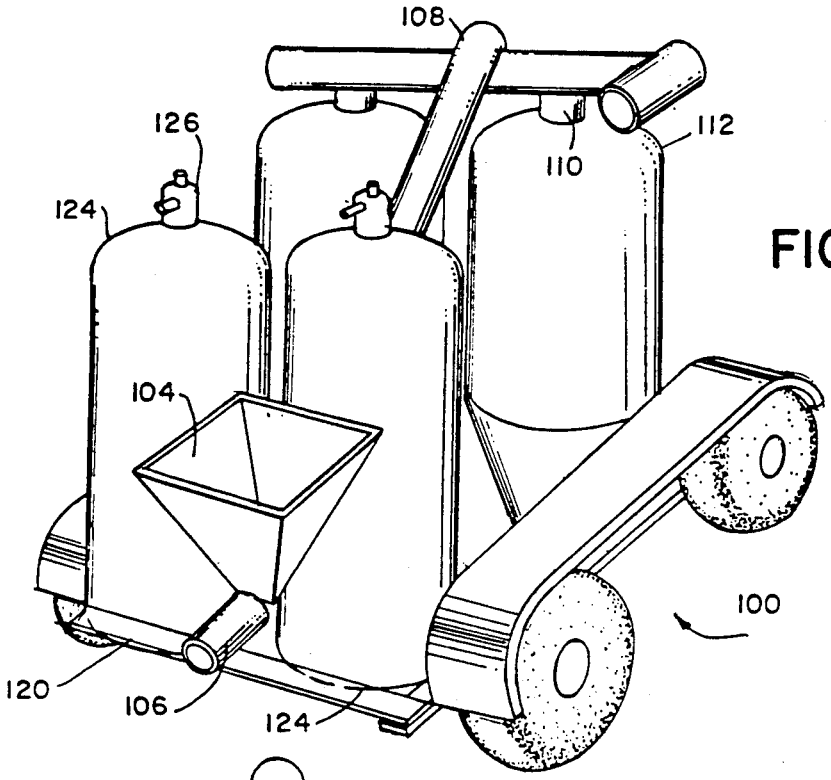
FIG. 4 is a perspective view of the trailer.
Figure 3:
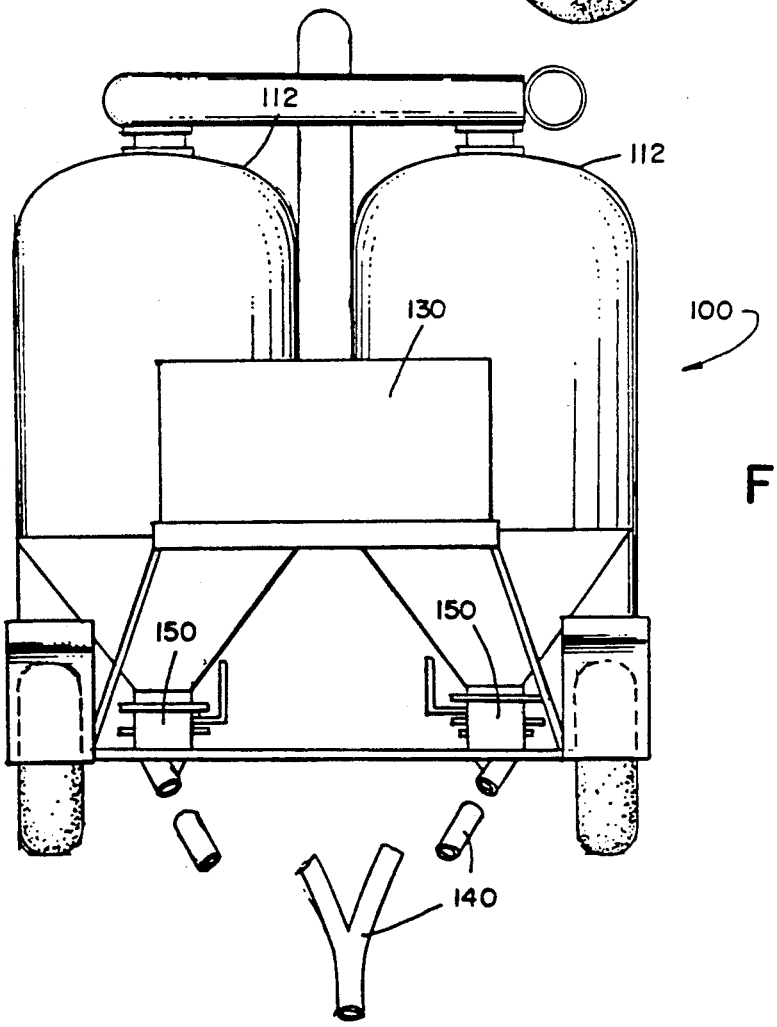
FIG. 3 is an end view the trailer of FIG. 2.

FIGS. 2 to 4 show a transportable material handling pump system 100 that includes the kind of components of the pneumatic particulate blaster apparatus 10 shown in FIGS. 1 and 1A and that is portably mounted in a generally well-known manner on a truck or trailer base 102 and having a conventional tow bar (not shown). Although the description allows only one system 100 of elements to be shown, the following description allows for a plurality of each of the units in the system 100. On the base 102 there is mounted particulate material receiving hopper(s) 104 for receiving material for passing through the hopper(s) 104 into, for example, by auger drive motors 106 and thence upwardly along elevator screw conveyors 108 through a set or arrangement of bin charging valves 110 into pressurized material tanks 112. The pressurized material tanks 112 receive the particulate material therein to a level 114 located proximate bin level switches 116 for sensing the proximity of the level of the particulate material to the location of bin level switches 116, and which switches control and turn OFF the inflow of particulate material 114 by control, for example, by the auger drive motors 106. Other bin level switches 118 are provided to control and turn ON the inflow of particulate material 114, when the particulate material level descends to levels proximate the location of the bin level switches 118.

The mix may be conveyed through a conncetion such as a Siamese hose 140 to a nozzle similar to nozzle 52 of FIG. 1, as may be required. Pneumatic material pump(s) 150 are provided as the pump of FIGS. 1 and 1A to convey the material to hose 140.

Compressed air header 120 with attending pop-off and control valves 122, and pressurized water tanks 124 with attending pop-off and control valves 126 are provided for supply of air and water into the pressurized material tanks 112; and operation of control systems (not shown) as are well-known in the prior art, is by use of a gasoline or diesel engine driving an electrical generator system 130. The system 100 thus may be displayed and disposed upon a truck or trailer 102 of the system 100.

The apparatus of the pneumatic particulate blaster apparatus 10 of the invention, or of the pump system 100 of the invention, or both of them, may be so constructed and arranged in their component parts that it may be assembled as a kit or in kit form.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

What is claimed and desired to be secured by Letters patent is:

1. Pneumatic particulate blaster apparatus comprising a hopper having an open top for receiving particulate material and having a lower terminus communicating with generally cylindrically configured hollow tubing having a proximate end and a distal end, vibrating means mounted on an inclined side of the hopper, auger means in the tubing for feeding the particulate material received from the hopper to the distal end of the tubing and being driven by a prime mover from the proximate end of the tubing, a nozzle communicating with the distal end of the hollow tubing, particulate mix chamber communicating with the distal end of the tubing and receiving air at an inlet above the particulate mix chamber allowing particulate mix to aerate with air in the particulate mix chamber and thereupon exiting adjacent a set of multiple venturi orifices in the nozzle communicating therewith, a contoured throat disposed upstream of the set of multiple venturi orifices for accelerating flow of the particulate mix as the particulate mix passes the contoured throat, an air receiver tank for communicating with the multiple venturi orifices and having the multiple venturi orifices disposed and generally inclined about 10° to an axis of the nozzle for ingress of pressurized air from air receiver tank into the multiple venturi orifices, and termination orifice at the exit of the nozzle directing ejection of air, water, and particulate mix to a work surface means.

2. The apparatus of claim 1 wherein the multiple venturi orifices are of about ⅛ inch diameter.

3. The apparatus of claim 1 wherein the particulate mix to air ratio at the nozzle is about 1:4 ratio.

4. The apparatus of claim 1 wherein the nozzle includes an inlet for receiving water through a water control valve.

5. The apparatus of claim 1 wherein the prime mover is an electric motor and provides metering of the particulate material.

6. The apparatus of claim 1 wherein the air at the inlet to the particulate material chamber is at atmospheric pressure.

7. The apparatus of claim 1 wherein the auger spreads particulate material into the particulate material chamber.

8. The apparatus of claim 1 wherein a diametric dimension the particulate material chamber reduces as the particulate material chamber procedes towards the nozzle.

9. The apparatus of claim 1 wherein the particulate material chamber has significant volume and distance in allowing air to mix in the particulate material chamber.

10. The apparatus of claim 1 wherein the hopper is located at a level above a level of the nozzle, and the blaster apparatus is mounted on a vehicular trailer.

* * * * *